United States Patent [19]

Joshi

[11] 4,156,707

[45] May 29, 1979

[54] METHOD FOR PRODUCING MULTICOLORED, VARIEGATED SOAP

[75] Inventor: David P. Joshi, Piscataway, N.J.

[73] Assignee: Colgate-Palmolive Company, New York, N.Y.

[21] Appl. No.: 875,465

[22] Filed: Feb. 6, 1978

Related U.S. Application Data

[63] Continuation-in-part of Ser. No. 619,716, Oct. 6, 1975, abandoned.

[51] Int. Cl.[2] ..... C11D 13/08; C11D 13/18; C11D 13/22; C11D 13/26

[52] U.S. Cl. ..... 264/75; 252/90; 252/134; 252/367; 252/368; 252/371; 264/101; 264/148

[58] Field of Search ..... 252/90, 92, 108, 134, 252/367, 368, 369, 370, 371; 264/73, 74, 75, 101, 109, 118, 138, 148; 425/131.1

[56] References Cited

U.S. PATENT DOCUMENTS

| | | | |
|---|---|---|---|
| 850,003 | 4/1907 | Houchin et al. | 252/367 |
| 3,769,225 | 10/1973 | Matthaei | 252/367 |
| 3,940,220 | 2/1976 | D'Arcangeli | 252/90 |
| 3,976,736 | 8/1976 | Paris et al. | 252/370 X |

FOREIGN PATENT DOCUMENTS

| | | | |
|---|---|---|---|
| 139352 | 11/1950 | Australia | 252/367 |
| 3167 of | 1862 | United Kingdom | 252/370 |
| 20916 of | 1907 | United Kingdom | 252/367 |
| 380820 | 9/1932 | United Kingdom | 252/367 |

*Primary Examiner*—Harris A. Pitlick
*Attorney, Agent, or Firm*—Herbert S. Sylvester; Murray M. Grill; John A. Stemwedel

[57] ABSTRACT

The invention provides a method for producing multicolored soap, either in chip or bar form including the steps of preparing a soap slurry, solidifying the soap slurry, reducing the solidified soap to particulate form, spraying the solidified soap with a liquid coloring agent and drying the colored particulate soap. The dried particulate soap can be further processed by plodding to form variegated bars or used as soap chips, pellets or ribbons.

5 Claims, 1 Drawing Figure

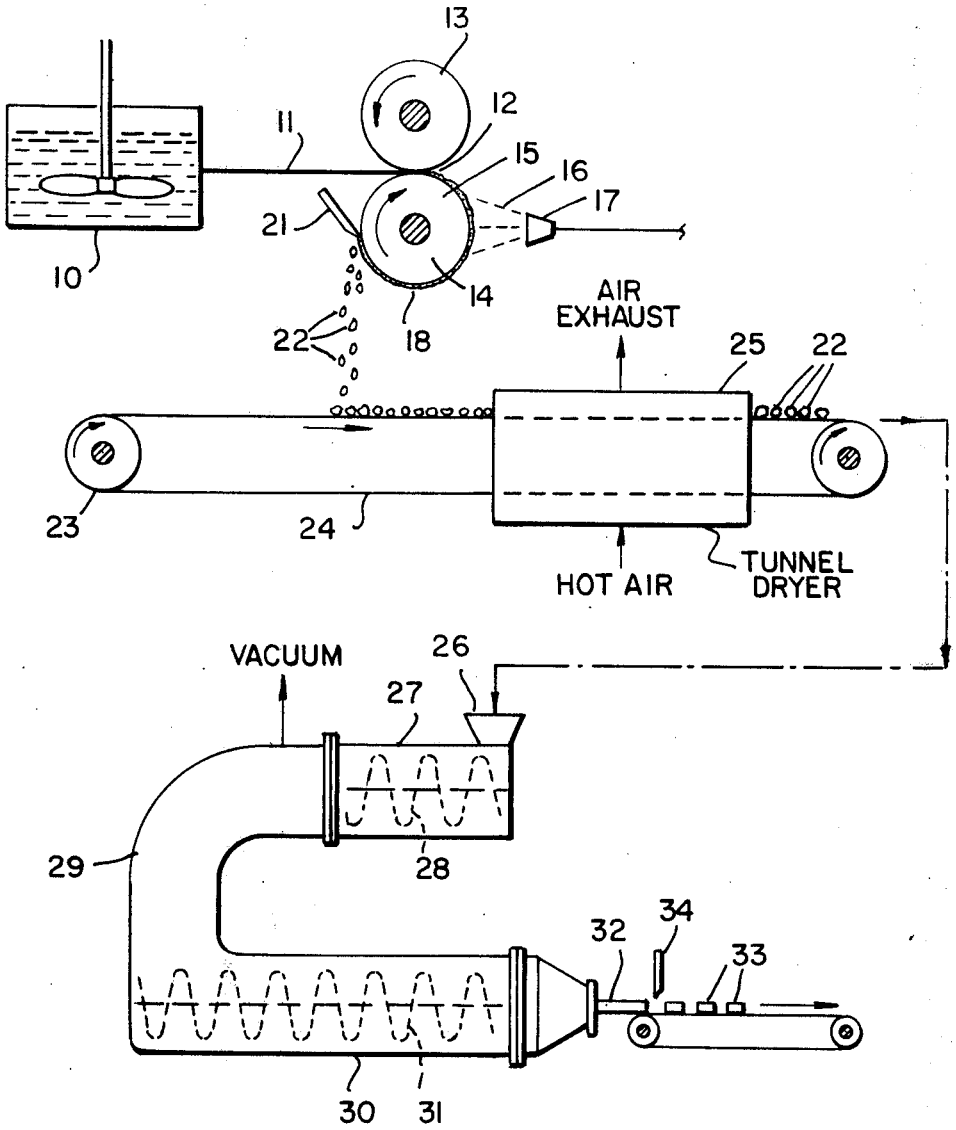
13
12
11
15
16
17
21
10
14
18
22
AIR
EXHAUST
25
22
23
24
HOT AIR
TUNNEL
DRYER
VACUUM
26
27
28
29
32
34
33
30
31

METHOD FOR PRODUCING MULTICOLORED, VARIEGATED SOAP

RELATED APPLICATIONS

This application is a Continuation-In-Part of Ser. No. 619,716 filed Oct. 6, 1975 and now abandoned.

BACKGROUND OF THE INVENTION

The present invention relates to soap making. More specifically, the invention provides a method for the production of variegated soap chips and/or bars. The term "soap" is used generically herein to define a cleansing agent of either the natural or synthetic type including anionic, cationic and nonionic detergents such as ethoxylated alcohol sulfates and olefin sulfonates as well as saponified fatty acid soaps and combinations of the foregoing materials.

The particulate soap produced by the new method is esthetically attractive and can have a whitish background with colored streaks such as green and blue or the background can be colored and the streaks chosen to contrast with the background color. Additionally, and in accordance with a specific aspect of the invention, the variegated particulate soap produced by the new method can be further processed in a conventional double barrel vacuum soap plodder to produce an extruded and variegated soap billet which can be cut and pressed into bar form. As used herein the term "particulate soap" or "particulate form" means either chips, ribbons, pellets etc. of the relevant material.

A primary advantage of the new method is to produce variegated soap bars using a conventional double barrel vacuum plodder apparatus. A still further advantage of the invention is to produce esthetically atrractive variegated particulate soap for laundry use.

SUMMARY OF THE INVENTION

The foregoing and other advantages are achieved by the method of the invention which includes the following steps: (All percentages are by weight unless otherwise specified), preparing an aqueous soap slurry, solidifying said slurry, applying a coloring agent to said solidified slurry, reducing said solidified slurry to particulate form and drying said particulate soap, said drying step being subsequent to said applying step. The soap slurry can include additives such as perfume, coloring agents emolients, bacteriostats in accordance with conventional soap making practice and contains from about 20% to about 40% water, preferably at least 30% (kettle soap). The particulate form of the soap can be chips, pellets or ribbons. The particulate soap is dried to a water content of from about 2 to about 12% by weight in a conventional drying apparatus.

According to the invention, the coloring agent can be applied to the solidified soap either prior or subsequent to the step of reducing the solidified soap to particulate form. However, in either case the coloring agent is added to the solidified soap while it is a "wet" state i.e., while it has a water content of about 20% to 40% by weight and prior to the step of drying the wet soap to a water content of from about 2% to about 12% by weight.

More specifically, and in accordance with a preferred aspect of the invention, the new method includes preparing a soap slurry; supplying the soap slurry to the nip of a pair of rollers; solidifying a film of soap slurry on the surface of one of the rollers; applying a liquid coloring agent to the solidified film or soap; removing the solidified film from the roller and simultaneously with the removing step subdividing the solidified film to particulate form, conveying the particulate soap to a drying apparatus; and drying the particulate soap to a water content of from about 2% to about 12% by weight.

If it is desired to produce multi-colored variegated soap bars as the final product of the invention the following additional method steps are performed subsequent to the production of dried (2–12% water) variegated particulate soap to a plodder, plodding the particulate soap, said plodding step mixing the particulate soap to produce a variegated soap mass, extruding the variegated soap mass in the form of a continuous billet and subdividing said billet into bars.

BRIEF DESCRIPTION OF THE DRAWING

FIG. 1 is a schematic showing the steps of the new method.

FIG. 2 is a schematic of a portion of the new method showing an alternate embodiment.

The invention will be described in further detail with reference to the accompanying drawing.

DETAILED DESCRIPTION

Referring to the drawing, a soap slurry is prepared in a blending apparatus (crutcher) 10 by mixing ingredients such as saponified fatty acids, water, perfume, bacteriostats, emollients, builders, etc. The soap slurry typically contains from about 30 to about 35% by weight of water although the water content of the slurry in the crutcher can vary from about 20 to about 45% by weight. The slurry is then solidified by any known method, preferably using a pair of chilled rollers. The slurry 11 is conveyed and supplied to the horizontal nip 12 formed by a pair of rollers, 13 and 14.

The uppermost roller 13 is heated to an elevated temperature, usually above about 150° F. preferably from about 200° F. to about 210° F. The heating can be accomplished by circulating hot water through a hollow roller. The lowermost roller 14 is cooled or chilled to a reduced temperature, usually below 90° F. and preferably between about 40° F. and about 60° F.

The soap slurry exits from the nip 12 as a solidified film 15 on the surface of the chilled roller 14. According to one aspect of the invention, a liquid coloring agent 16 such as an aqueous or non-aqueous solution or dispersion of a dye or pigment of desired color is either dripped or sprayed onto the soap film 15, by means of spray nozzle 17 to produce a streaked soap film 18. Typically spray nozzle 17 includes a plurality of manifolded sprayers disposed along the horizontal length of chilled roller 14. The streaked soap film 18 is then conveyed downstream of the horizontal nip 12 where knife blade 21 is disposed and functions to scrape the variegated soap film 18 off the surface of roller 14 and to simultaneously break the variegated film 18 into particulate form 22. The particulate soap 22 falls onto a conveyor 23 that includes a perforated screen belt 24. The belt 24 carries the particulate soap through a tunnel dryer 25 wherein hot air is blown through the belt 24 and around the soap to evaporate water. Preferably the dried particulate soap **22*a* leaving the tunnel dryer 25** has a water content from about 2% to about 12% by weight.

Alternatively and as shown in FIG. 2, the coloring agent 16 can be sprayed or dripped onto the solidified soap after particulate soap 22 is formed such as on conveyor belt 24 while being transported to the tunnel dryer 25.

According to the invention, the dried and variegated particulate soap can be packaged and sold as an esthetically attractive laundry product or as an additive to spray dried laundry powders or they can be processed further into bar form. In accordance with this latter aspect of the invention, the particulate soap 22a can be fed to the inlet 26 of a conventional double barrel vacuum plodder. The soap is mixed and refined in the upper barrel 27 of the plodder by plodder screw 28 and extruded in the form of strands or pellets into vacuum chamber 29 wherein entrapped air is removed. The soap, now in the form of a variegated soap mass, is fed into the lower barrel 30 of the plodder wherein plodder screw 31 further refines the soap mass. The refined soap mass is then extruded in the form of a continuous variegated billet 32 which can be cut into individual variegated bars 33 by cutter 34. The bars can then be shaped, stamped wrapped for distribution.

The variegated soap bars produced according to the invention have distinct and esthetically pleasing variegations. Since the coloring agent was added to the solidified soap material while it was in a wet state i.e., before the tunnel dryer, the coloring agent is "locked" into the soap and does not spread through the soap mass during plodding to produce indistinct variegations or background color, which might happen if the coloring agent was applied to the soap after the tunnel dryer i.e., when the soap was in a dry state. A further advantage of the method of the invention is to avoid non-uniformity of moisture in the final bar, thereby reducing cracking which is a common problem when a liquid coloring agent is added to the dried soap as in prior art variegating methods.

The invention can be further illustrated by the following example:

A white soap slurry having the following composition is prepared in a conventional mixing apparatus:

| INGREDIENT | AMOUNT (WEIGHT %) |
|---|---|
| 20% coco/80 Tallow saponified soap | 80% |
| alfa olefin sulfonate | 18% |
| Titanium dioxide | 1% |
| Preservatives, dye | 1% |
| | 100% |

The slurry is fed to the nip 12 which is defined by hot roll 13 operating at a surface temperature of 205° F. and chilled roll 14 operating at a surface temperature of 50° F. The soap slurry solidifies on the surface of the chilled roll 14 to form film 15.

A coloring agent comprising by weight, an aqueous solution of 18% coloring material such as FD & C Blue No. 2, 2%, sodium carboxy methyl cellulose (CMC) and 80% water, is sprayed onto the film 15 by nozzle 17 in an amount of 1 gram per 100 grams of soap (1% by weight). The amount of coloring agent can be varied from about 0.1 to about 5% by weight of the colored soap prior to drying, depending upon the effect desired and the concentration of coloring material in the coloring agent. The coloring material forms random streaks on the film 15 and because of the high moisture content i.e., typically about 30%, of the film, the aqueous based colored solution is readily absorbed by the soap material. The final concentration of coloring material in the dried soap can be from about 0.005 to about 1% by weight.

Although the coloring agent typically includes water and a dye or pigment it is within the scope of the invention to incorporate perfumes, bacteriostats and other ingredients into the coloring agent, or to use other vehicles such as hot waxes, liquid nonionic detergents etc.

I claim:

1. A method for preparing multi-colored, variegated soap bars, comprising, preparing an aqueous soap slurry containing at least about 30 percent water by weight, solidifying said slurry, reducing said solidified slurry to particulate form, applying a liquid coloring agent to the solidified slurry either prior or subsequent to said reducing step drying said particulate soap subsequent to said applying step to a water content from about 2 to 12 percent by weight, conveying said dried particulate soap to a plodder, plodding said particulate soap subsequent to said drying step, said plodding step including mixing said particulate soap to produce a variegated soap mass, extruding said variegated soap mass in the form of a continuous billet and subdividing said billet into bars.

2. The method of claim 1 wherein said plodder includes a pair of barrels, each barrel containing a screw and being separated by a vacuum chamber.

3. The method of claim 1 wherein said solidified slurry is sprayed with an aqueous solution of coloring agent.

4. The method of claim 3 wherein said aqueous solution of coloring agent is supplied in an amount to result in a dried colored soap containing from about 0.005 to about 1 percent by weight coloring material.

5. The method of claim 1 wherein said applying step is subsequent to said reducing step.

* * * * *